United States Patent [19]

Kitamura et al.

[11] Patent Number: 5,024,314

[45] Date of Patent: Jun. 18, 1991

[54] ESCALATOR SYSTEM WITH CONVERTIBLE STEPS FOR WHEEL CHAIR

[75] Inventors: Shigeharu Kitamura; Haruhiko Nakamura, both of Inazawa; Masaru Sanada, Osaka, all of Japan

[73] Assignee: Mitsubishi Denki Kabushiki Kaisha, Japan

[21] Appl. No.: 363,082

[22] Filed: Jun. 8, 1989

[30] Foreign Application Priority Data

Jun. 9, 1988 [JP] Japan ..... 63-142024
Jun. 30, 1988 [JP] Japan ..... 63-163414
Jun. 30, 1988 [JP] Japan ..... 63-163415

[51] Int. Cl.[5] ..... B66B 23/12
[52] U.S. Cl. ..... 198/333
[58] Field of Search ..... 198/321, 324, 326, 333

[56] References Cited

U.S. PATENT DOCUMENTS 4,557,369 12/1985 Ishida et al. ..... 198/333
4,569,433 2/1986 Ishida et al. ..... 198/333
4,681,207 7/1987 Goto et al. ..... 198/333
4,682,681 7/1987 Teranishi et al. ..... 198/333

FOREIGN PATENT DOCUMENTS 59-7685 1/1984 Japan .
203085 11/1984 Japan ..... 198/333
59-230985 12/1984 Japan .
60-23283 2/1985 Japan .
60-52487 3/1985 Japan .
60-238285 11/1985 Japan .

OTHER PUBLICATIONS

U.S. Department of Commerce NTIS, "Escalator Modification for the Handicapped", Jul. 1980, pp. 11-20, 42-54.

*Primary Examiner*—Joseph E. Valenza
*Attorney, Agent, or Firm*—Leydig, Voit & Mayer

[57] ABSTRACT

An escalator system has a plurality of steps connected to form an endless loop having a load-bearing run and a return run and circulatingly driven along a circulating path defined on a main frame. A movable member mounted on at least one of the steps is movable to an elevated position on the level of a tread of the step in front of that particular step in the load-bearing run. An operating mechanism is connected to the movable member for elevating the movable member. The operating mechanism comprises first and second racks mounted on the main frame at end portions of the loop. A forward-rotation pinion is mounted on the step with the movable member or on the step next to the step for engagement with the first rack, and a reverse-rotation pinion is mounted on the step with the movable member or on the step next to the step for engagement with the second rack. A drive force transmitting mechanism is connected to the operating mechanism for driving the operating mechanism in different directions by the forward-rotation pinion or the reverse-rotation pinion.

13 Claims, 16 Drawing Sheets

ESCALATOR SYSTEM WITH CONVERTIBLE STEPS FOR WHEEL CHAIR

BACKGROUND OF THE INVENTION

This invention relates to an escalator system and, more particularly, to an escalator system with convertible steps for receiving thereon a wheel chair or the like for the handicapped.

Examples of the conventional designs of the escalator to which the present invention pertains can be found in Japanese Patent Laid-Open No. 59-230985 and Japanese Patent Laid-Open No. 60-23283, in which a tread board of some of the steps is moved up and down at the landings as well as Japanese Patent Laid-Open No. 60-238285 in which a wheel stopper mounted on some of the steps can be raised, and Japanese Patent Laid-Open No. 60-52487 wherein one portion of the tread board is moved up and down between an inclined position and a horizontal position. In these escalator systems, in order to utilize the movable member such as the tread board, the wheel stopper and tiltable tread board, the escalator must be stopped each time the movable member is located at the upper and lower landings, where a movable member drive mechanism such as an electric motor disposed at the upper and the lower landings must be manually operated, whereby the movable member is driven into the actuated position at the entrance of the escalator and driven into the inactuated position at the exit of the escalator.

In a conventional escalator system with convertible steps as described above, the operation of the escalator system must be temporarily stopped in order to actuate the movable member between the actuated and inactuated positions, decreasing the transportation capacity of the escalator system.

SUMMARY OF THE INVENTION

Accordingly, an object of the present invention is to provide an escalator system with convertible steps free from the above-described disadvantage.

Another object of the present invention is to provide an escalator system with convertible steps in which the movable member can be moved back to the inactuated position without the need for stopping the escalator at at least the exit of the escalator.

Another object of the present invention is to provide an escalator system with convertible steps in which the movable member of the steps can be moved between the actuated and inactuated positions without the need for stopping the escalator at both the entrance and the exit of the escalator.

Still another object of the present invention is to provide an escalator system with convertible steps in which the transportation capacity is not unreasonably decreased.

With the above objects in view, the escalator system with convertible steps according to the present invention comprises a plurality of steps connected to form an endless loop having a load-bearing run and a return run and circulatingly driven along a circulating path defined on a main frame, a movable member mounted on at least one of the steps, the movable member being movable to an elevated position at an equal level of a tread of the step in front of that particular step in the load-bearing run, and an operating mechanism connected to the movable member for elevating the movable member. The operating mechanism comprises first and second racks mounted on the main frame at end portions of the loop and each having a plurality of teeth disposed along the direction of movement of the steps, a forward-rotation pinion mounted on the step with the movable member or on the step next to the step for engagement with the first rack for forward rotation thereof upon movement of the step, a reverse-rotation pinion mounted on the step with the movable member or on the step next to the step for engagement with the second rack and a drive force transmitting mechanism connected to the operating mechanism for driving the operating mechanism in the different directions by the forward-rotation pinion or the reverse-rotation pinion.

The escalator system may further comprise a rack raising mechanism for raising and lowering the racks. The rack raising mechanism may comprise a detector for detecting the presence of the step with the movable member at the landings of the escalator for automatically driving the rack raising mechanism.

BRIEF DESCRIPTION OF THE DRAWINGS

The present invention will become more readily apparent from the following detailed description of the preferred embodiments of the present invention considered in conjunction with the accompanying drawings, in which.

DESCRIPTION OF THE PREFERRED EMBODIMENTS

A first embodiment of the present invention will now be described in conjunction with FIGS. 1 to 6 of the drawings.

Figure 5:
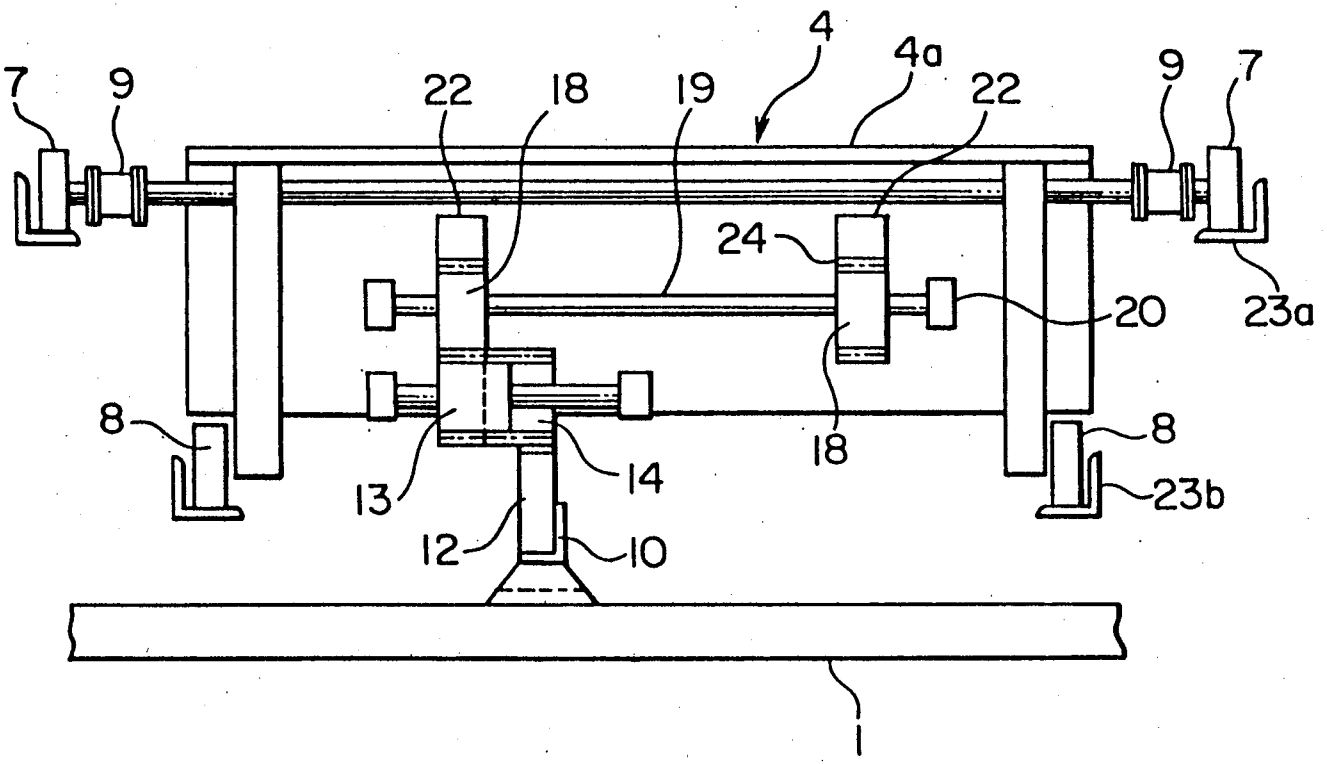
FIG. 5 is a sectional view taken along Line V—V of FIG. 4.
Figure 6:
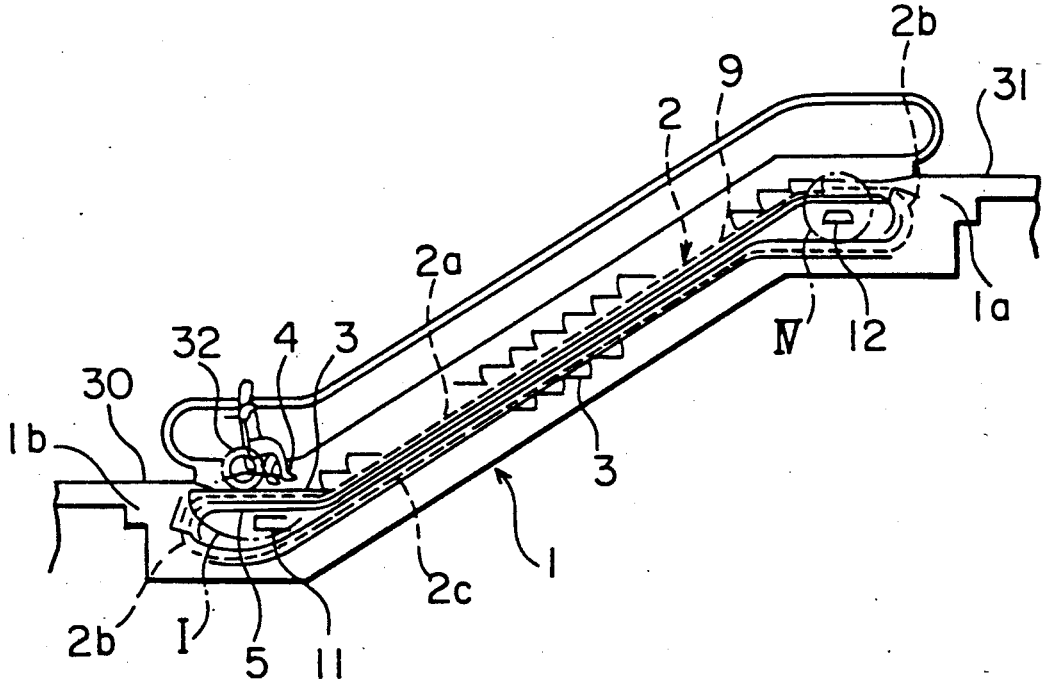
FIG. 6 is a schematic sectional side view showing the escalator system of the first and the second embodiments of the present invention.

In FIG. 6, the escalator system of the present invention comprises an inclined main frame 1 in which an endless circulating path 2 formed mainly by rails disposed within the main body is defined. The circulating path 2 comprises a load-bearing run 2*a* on the upper portion of the main frame 1, a turn-around portion 2*b* at each of the upper and the lower end portions 1*a* and 1*b*, and a return run 2*c* in the bottom portion of the main frame 1. The escalator system also comprises a plurality of ordinary steps 3 disposed along the circulating path 2, a few operating steps 4 disposed between the ordinary steps 3, and movable steps 5 with a movable member, the movable steps 5 being disposed next to the riser side of the operating step 4 or the side of the step 4 close to the lower end of the main frame 1. As shown in FIGS. 1 to 5, steps 3, 4 and 5 each have front rollers 7 mounted at the opposite ends of a step axle 6 mounted on the front portion of the step and rear rollers 8 rotatably mounted on the rear portion of the step. Step axles 6 of the steps 3, 4 and 5 are connected at their ends to endless step chains 9 disposed at both sides of the steps, and the front rollers 7 and the rear rollers 8 are supported by guide rails 23*a* and 23*b* mounted within the main frame 1. When the step chains 9 are driven by a drive unit (not shown) mounted on the main frame 1, steps 3, 4 and 5 are moved upward or downward along the circulating path 2.

The escalator system of the present invention also comprises a first rack 11 rigidly mounted on the lower end portion of the main frame 1 by a mounting bracket 10, and a second rack 12 rigidly mounted on the upper end portion of the main frame 1 by a mounting bracket 10. Comparing FIGS. 3 and 5, it is seen that the racks 11 and 12 are disposed at different widthwise positions on the main frame 1 for the purpose which will become apparent later on. The racks 11 and 12 each have a plurality of teeth arranged in the direction of travel of the steps.

Operating step 4 having an operating mechanism therein comprises a forward rotation pinion 13 which can mesh with the first rack 11 and a reverse rotation pinion 14 which can mesh with the second rack 12. The forward rotation pinion 13 is rotatably supported by a pinion shaft 13*a* extending in the widthwise direction of step 4 and supported by bearings 15 secured to the step 4. The reverse rotation pinion 14 is rotatably supported by a pinion shaft 14*a* extending in the widthwise direction of the step 4 and supported by bearings 16 mounted on the step 4. The forward-rotation pinion 13 is in mesh at one side thereof with the reverse-rotation pinion 14 and at the same time in mesh with one of a plurality of intermediate gears 18 of a drive force transmission mechanism 17. The drive force transmission mechanism 17 has an intermediate gear shaft 19 extending in the widthwise direction of the step 4 in parallel to the pinion shafts 13*a* and 14*a*, and the intermediate gear 18 which is in mesh with the forward-rotation gear 13 is secured on one end of the intermediate gear shaft 19 and another intermediate gear 18 is secured on the other end of the intermediate gear shaft 19. The opposite ends of the intermediate gear shaft 19 are rotatably supported by bearings 20 mounted on the step 4, and the intermediate gears 18 are in engagement with a rack 24 formed in each bottom surface of left and right forks 22 of an operating mechanism 21. The operating mechanism 21 comprises the forks 22 supported slidably between an extended position and a retracted position by fork guide members 25. In the extended position, the forks 22 project from the riser of the operating step 4 and are inserted into holes 27*a* and 28*a* of the rear fork engagement members 27 and 28, and in the retracted position, the forks 22 are retracted under the tread board 4*a* of the operating step 4. The movable step 5 comprises a movable member 26 movably supported on a step main body 29. The movable member 26 has a movable tread board 26*a* and a movable riser downwardly extending from the rear end of the tread board 26*a*, and the movable riser slidably extending along the front of the riser disposed on the rear portion of the tread main body 29.

In the figures, reference numerals 30 and 31 designate landings, 32 designates a wheel chair and 33 and 34 designate comb members.

The structure of this first embodiment except for the first and the second racks 11 and 12, the forward-rotation and the reverse-rotation pinions 13 and 14 as well as the drive force transmitting mechanism 17 is substantially identical to that disclosed in Japanese Patent Laid-Open No. 60-23283.

The operation of the escalator system of the first embodiment of the present invention will now be described. During upward movement, steps 3, 4 and 5 travel in the righthand direction in the figure as shown by arrow A in FIG. 1, and the forward-rotation pinion 13 of the operating step 4 is brought into engagement with the first rack 11 rigidly attached to the lower end portion of the main frame 1. Since the forward-rotation pinion 13 is moved in the direction of arrow A in FIG. 1 as step 4 moves, the stationary first rack 11 causes the forward-rotation pinion 13 to be rotated in the clockwise direction as shown by arrow B. This rotation of the pinion 13 is transmitted to the intermediate 18 which is in mesh with the rack gear 24 on the forks 22 to push out the forks 22 from the riser of step 4 as shown by arrow D, whereby the forks 22 are inserted into the holes 27*a* and 28*a* of the fork receiving members 27 and 28 of the movable member 26 of the movable step 5.

It is to be noted that while the reverse-rotation pinion 14 is driven by the forward-rotation pinion 13 during the above operation, the reverse-rotation pinion 14 is in an idle state and its rotation is not transmitted to another component. Also, the above operation is carried out at the lower end portion of the load-bearing run 2*a* of the circulating path 2 where the tread board 4*a* of the operating step 4 and the treads of the movable tread board 26*a* of the movable step 5 are positioned at the same level and the forks 22 are inserted into the fork receiving members 27 and 28.

Under these circumstances, a wheel chair 32 (FIG. 6) can be moved from the entrance landing 30 onto the tread board 4*a* and the movable tread board 26*a*. When the operating step 4 is moved to the sloped portion of the load-bearing run 2*a* of the circulating path 2, the movable member 26 is elevated from the step main body 29 of the movable step 5 as the tread board 4*a* moves upwardly, with the tread board 4*a* and the movable tread board 26*a* maintained in the same horizontal level.

As the operating step 4 travels along the transition section at the upper end of the circulating path 2, the difference in the height or elevation of the tread board 4*a* of the operating step 4 with respect to that of the movable step 5 is decreased until the tread boards of the operating step 4 and the movable step 5 are positioned at the same level at the upper landing section of the circulating path 2.

Figure 4:
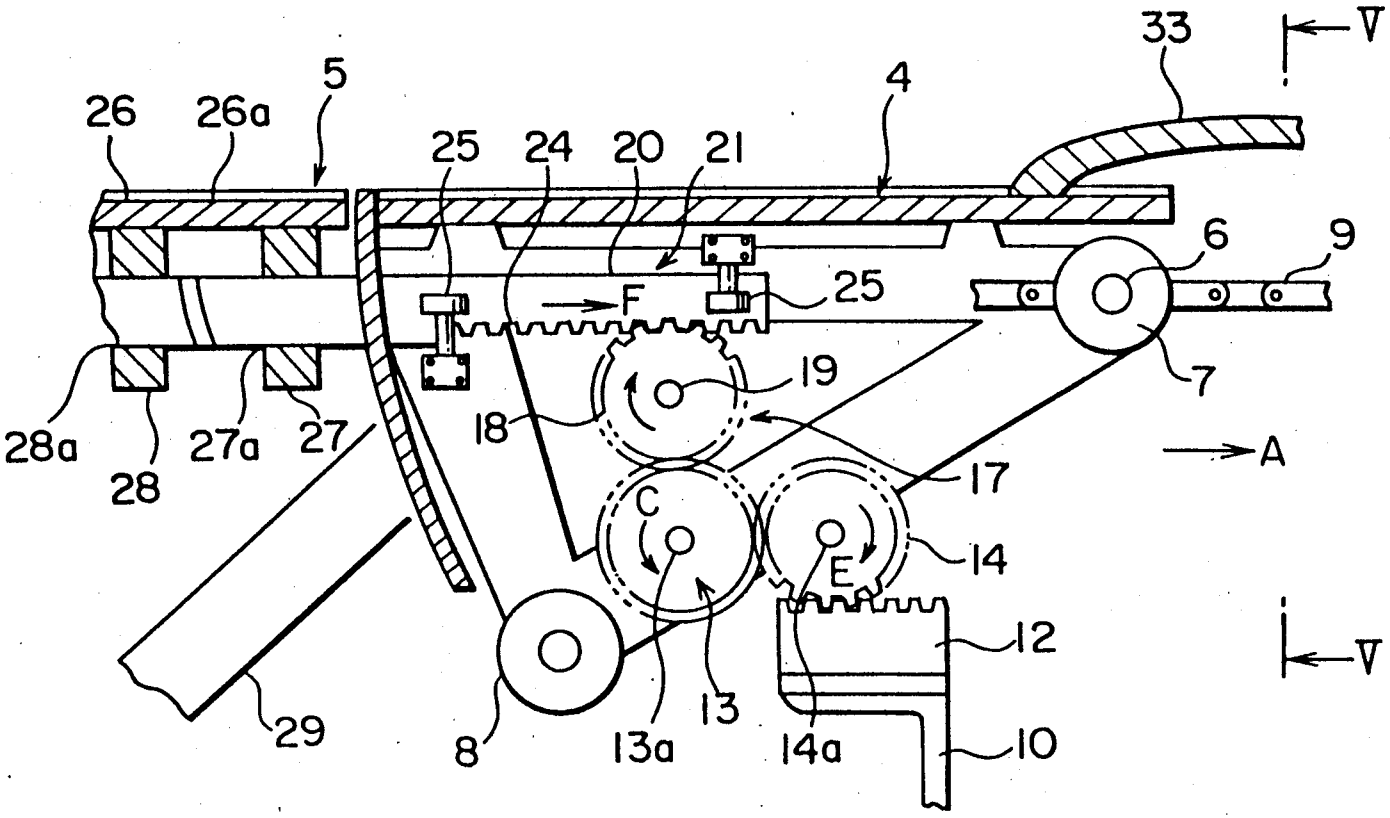
FIG. 4 is an enlarged vertical sectional view of the encircled portion IV of FIG. 1.

When the operating step 4 reaches the upper end portion of the load-bearing run 2a of the circulating path 2 and the tread boards of the steps 4 and 5 reach the same level, the reverse-rotation pinion 14 is brought into engagement with the second rack 12 secured at the upper end of the main frame 1 as shown in FIGS. 4 and 5. Then, the reverse-rotation pinion 14 is rotated clockwise as shown by arrow E in FIG. 4 and the forward-rotation pinion 13 is rotated counterclockwise as shown by arrow C, so that the intermediate gear 18 causes the forks 22 to be retracted as shown by arrow F from the fork receiving members 27 and 28 into the space under the tread board 4a.

During this operation, the wheel chair 32 can be moved from the tread board 4a of the step 4 and the movable tread board 26a of the movable step 5 onto the upper floor. Steps 4 and 5 are moved through an upper comb member 33 and along the upper turn-around portion 2b, the return run 2c and the lower turn-around portion 2b and then again reach the horizontal lower end portion of the load-bearing run 2a, where the operating step 4 and the movable step 5 of the escalator system repeat the above-described operation.

The downward moving operation of the escalator system is substantially similar to the upward moving operation as previously described. It is to be noted, however, that since the direction of travel of steps 3, 4 and 5 is opposite to that in the upward moving mode of operation, the forks 22 of the operating step 4 are inserted into the fork receiving members 27 and 28 of the movable step 5 when the reverse-rotation pinion 14 engages the second rack gear 12 at the upper end of the main frame 1, and the forks 22 are withdrawn from the fork receiving members 27 and 28 of the movable step 5 when the forward-rotation pinion 13 engages the first rack gear 11 at the lower end of the main frame 1.

If it is desired, the treads of the tread board 4a of the operating step 4 and the movable tread board 26a of the movable step 5 may be marked by coloring for the purpose of clearly distinguishing these steps 4 and 5 from other ordinary steps 3, whereby the wheelchair 32 or the like can be safely placed on the proper steps.

Figure 1:
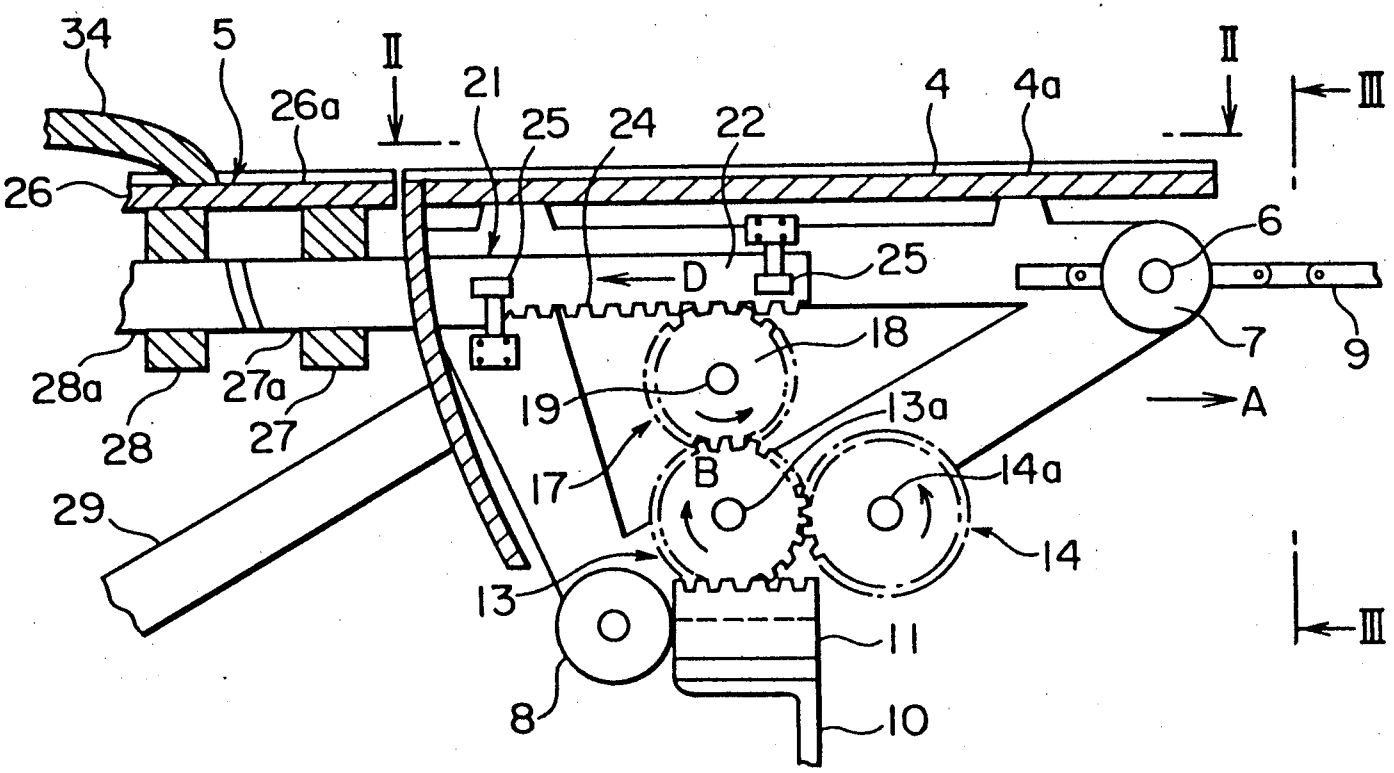
FIG. 1 is an enlarged vertical sectional view of the encircled portion I in FIG. 6 showing the escalator system of the first embodiment of the present invention.
Figure 2:
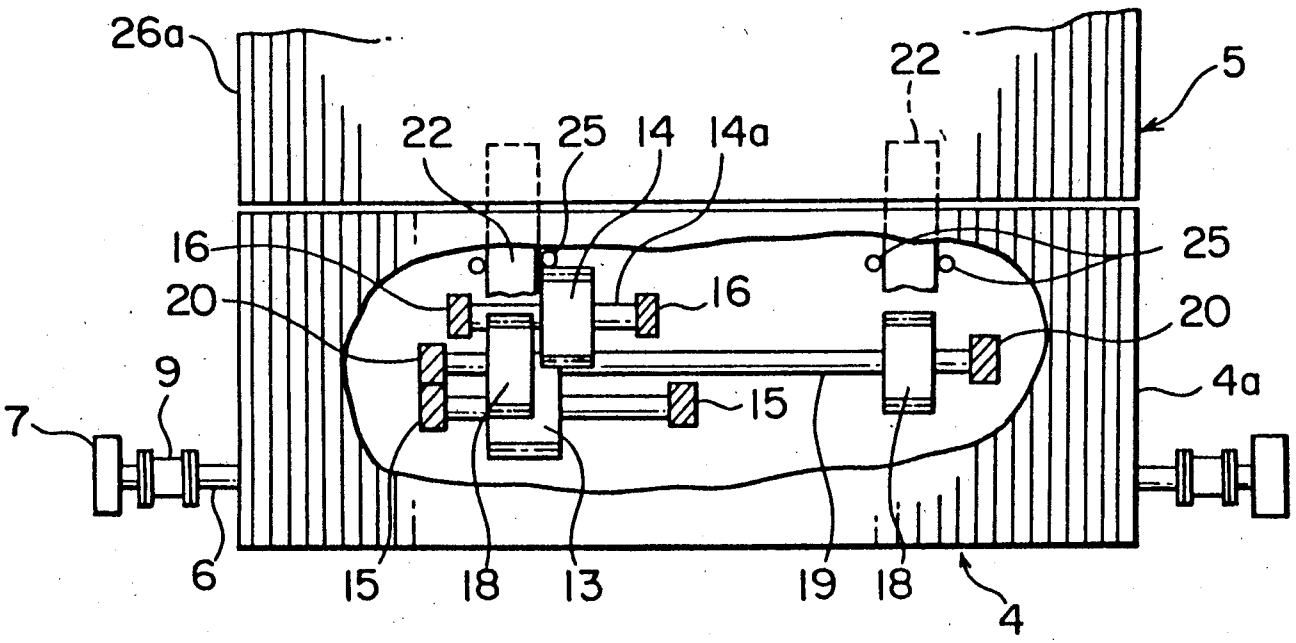
FIG. 2 is a partially removed plan view taken along Line II—II of FIG. 1.
Figure 3:
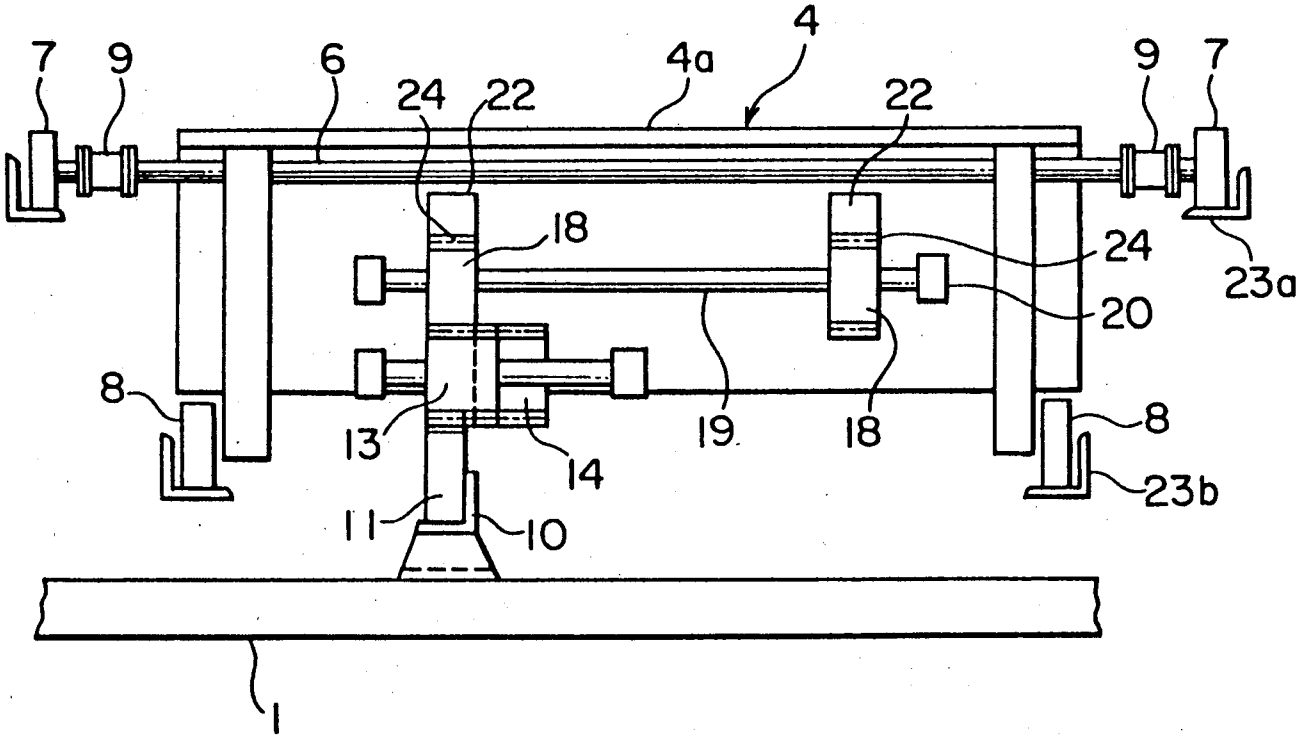
FIG. 3 is a sectional view taken along Line III—III of FIG. 1.
Figure 7:
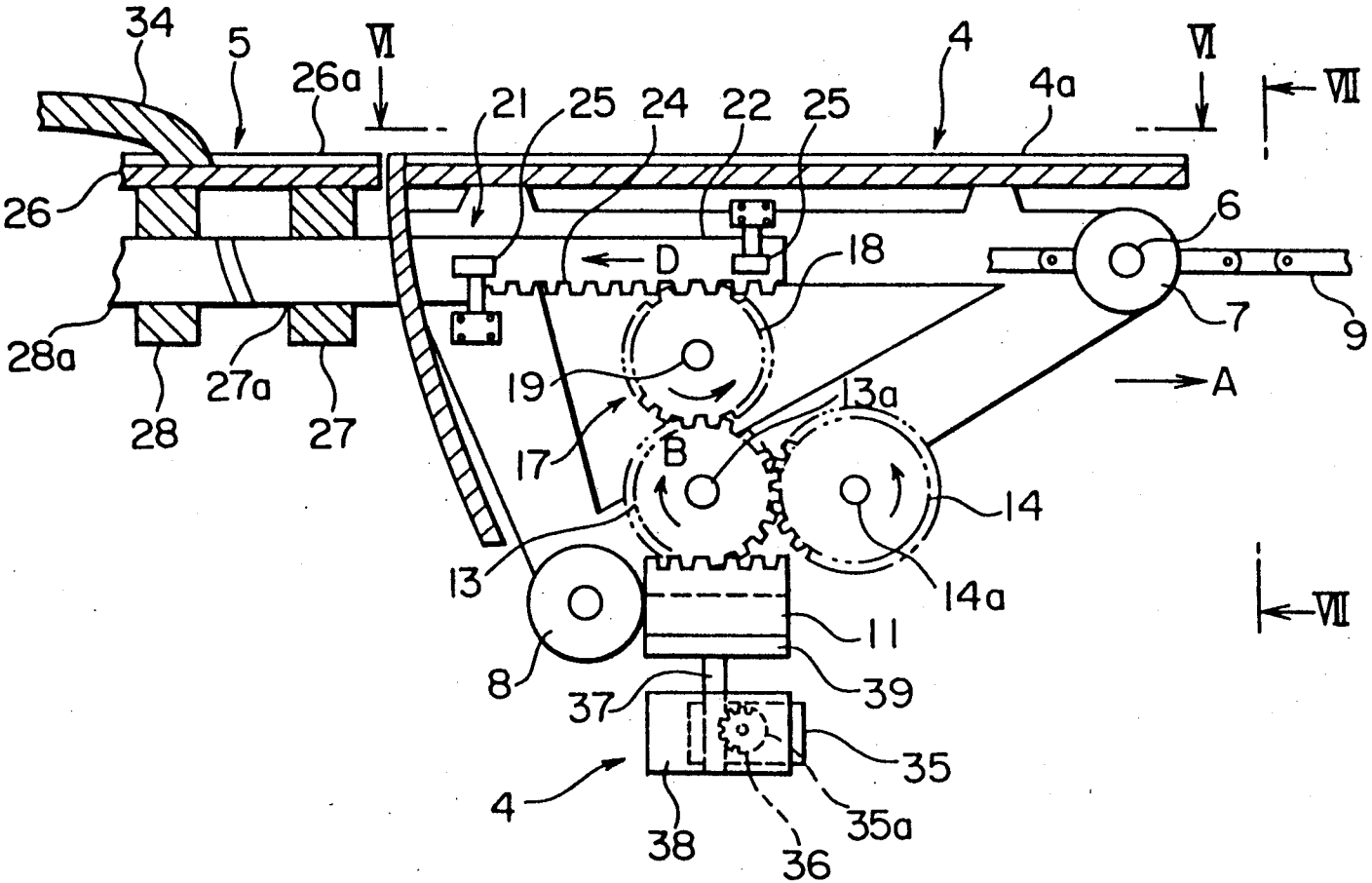
FIG. 7 is a view similar to FIG. 1 showing the escalator system of the second and the third embodiments of the present invention.
Figure 8:
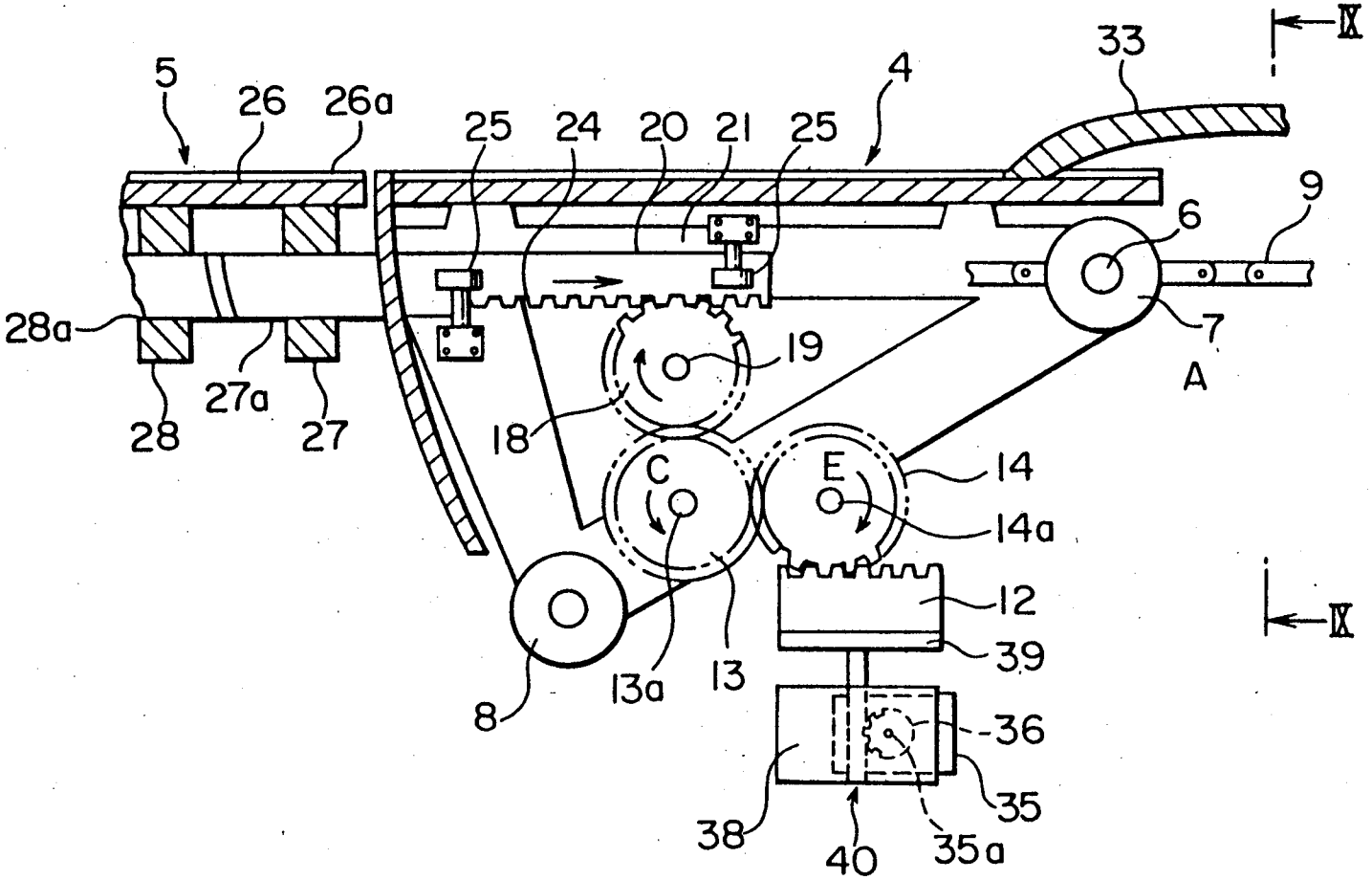
FIG. 8 is a view similar to FIG. 4 showing the second and the third embodiments of the present invention.
Figure 9:
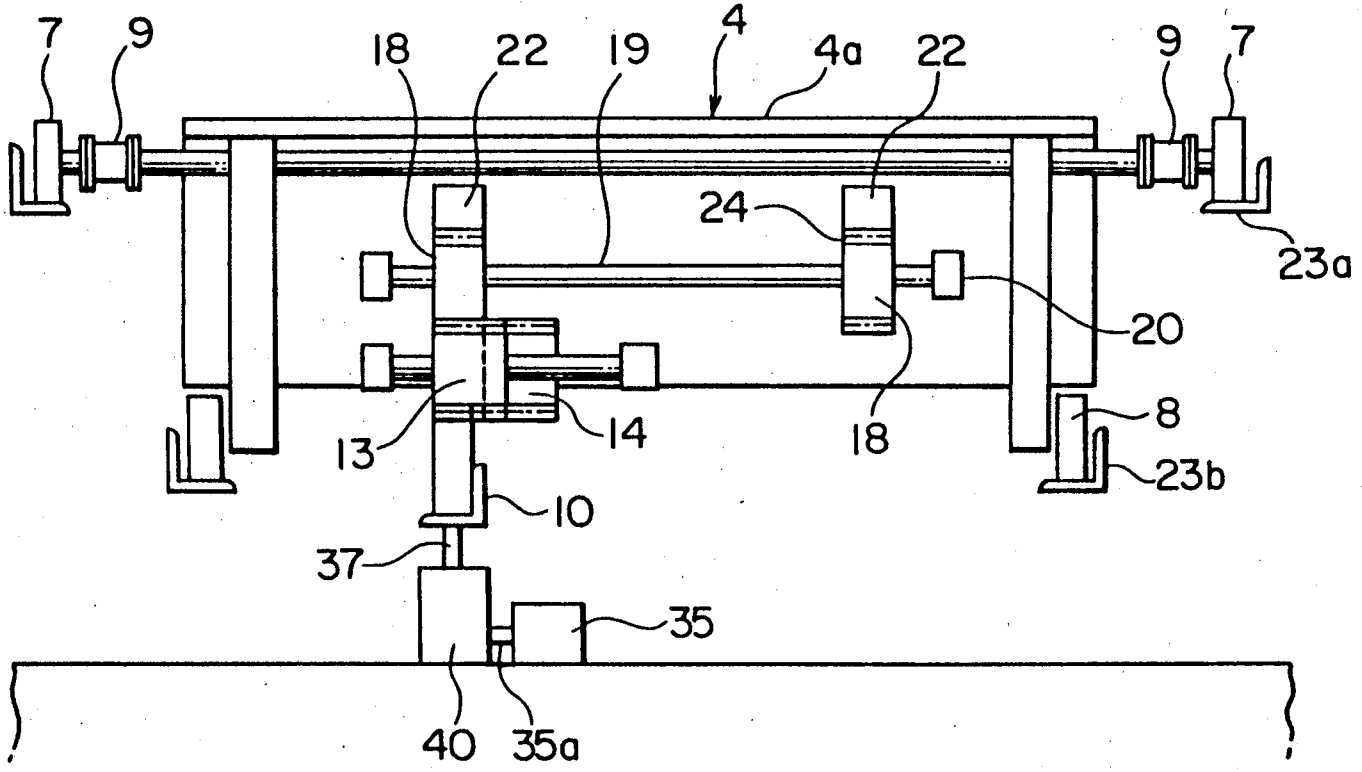
FIG. 9 is a view similar to FIG. 3 showing the second and the third embodiments of the present invention.
Figure 10:
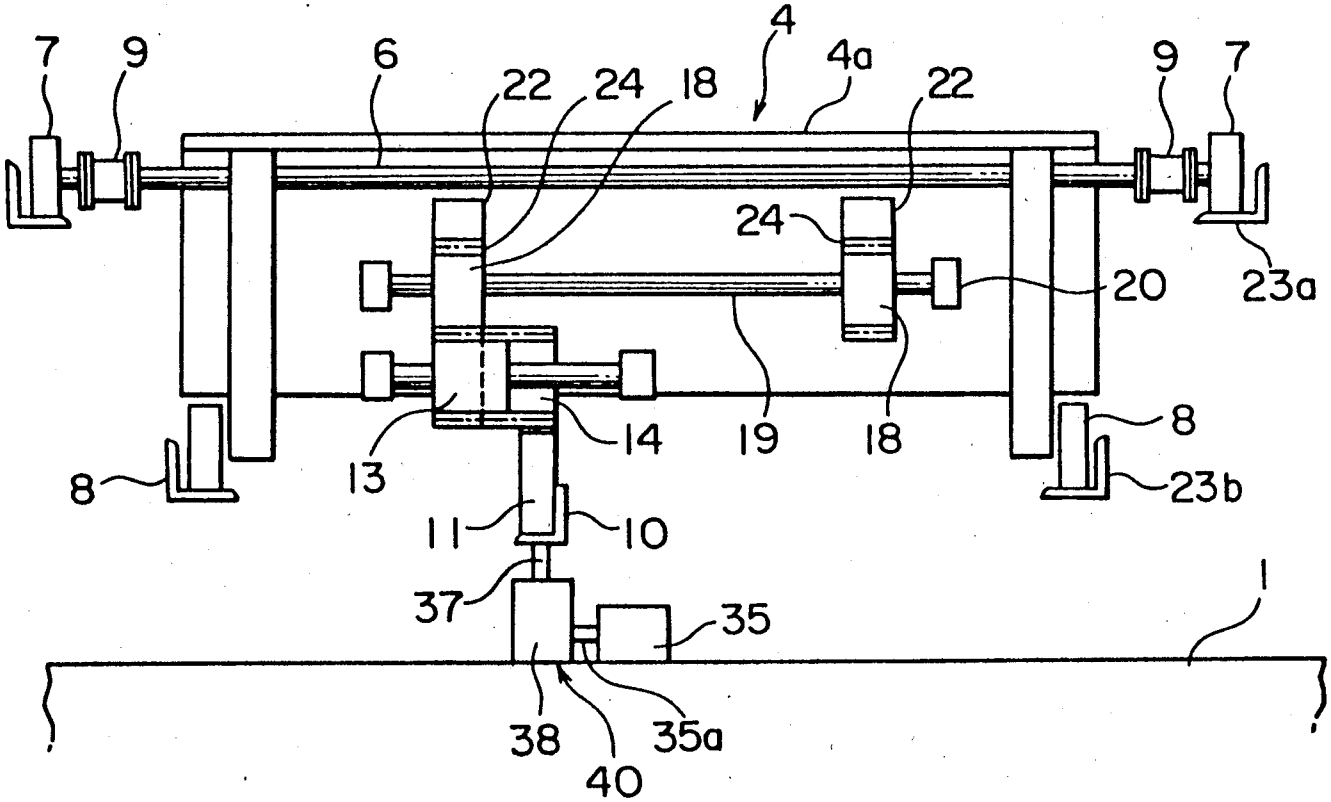
FIG. 10 is a view similar to FIG. 5 showing the second and the third embodiments of the present invention.

In FIGS. 7 to 10, an escalator system of a second embodiment of the present invention is illustrated. FIG. 7 is a view similar to FIG. 1 showing the escalator system of the second embodiment of the present invention, FIG. 8 is a view similar to FIG. 4 showing the second embodiment of the present invention, FIG. 9 is a view similar to FIG. 3 showing the second embodiment of the present invention, and FIG. 10 is a view similar to FIG. 5 showing the second embodiment of the present invention. The components corresponding to those shown in FIG. 6 are similar to those described in conjunction with the first embodiment, and the structure of the escalator system of this embodiment is identical to that of the first embodiment except that the first and the second racks 11 and 12 are arranged to be able to move up and down by jack mechanisms 40.

The jack mechanisms 40 each comprise a bi-directionarily rotatable electric motor 35 mounted to the main frame 1. The electric motor 35 has a shaft 35a on which a driving pinion 36 is secured, and a rack shaft 37 which is upwardly and downwardly slidably supported on the main frame 1 by a bearing member 38 and is in mesh with the driving pinion 36. The upper end of the rack shaft 37 has mounted thereon the first rack 11 through a mounting plate 39.

In the escalator system of this embodiment, assuming that the escalator is moving upwardly, when it is desired that the escalator system be brought into a mode of operation in which a wheel chair can be conveyed by a suitable means such as electrical switches, steps 3, 4 and 5 travel in the righthand direction as shown by arrow A in FIG. 7 and the electric motor 35 of the jack mechanism 40 at the lower end portion 1b of the main frame 1 is driven in the forward direction before the operating step 4 and the movable step 5 reach the lower end portion of the load-bearing run 2a of the circulating path 2. This rotation of the electric motor 35 causes the first rack 11 to be elevated by means of the driving pinion 36, the rack shaft 37 and the mounting plate 39 to a predetermined elevated position, in which the forward-rotation pinion 13 which travels as the step 4 travels meshes with and is driven by the first rack 11. The subsequent operation of the escalator system is the same as that described in conjunction with the first embodiment except that the second rack 12 is elevated to a predetermined elevated position, in which the reverse-rotation pinion 13 can mesh with and is driven by the second rack 12 before the operating step 4 reaches the upper end portion of the load-bearing run 2a by means of the upper jack mechanism 40 disposed in the upper end portion 1a of the main frame 1.

According to the second embodiment as above described, since the upper and the lower jack mechanisms 40 are actuated only when a wheel chair is to be conveyed by the escalator and they are not operated during the usual operation, the movable tread board 26a of the movable step 5 is in the inactuated lower position, whereby the operating step 4 and the movable step 5 can be used as ordinary steps 3 for conveying the passangers.

If it is desired, the treads of the tread board 4a of the operating step 4 and the movable tread board 26a of the movable step 5 may be marked by coloring for the purpose of clearly distinguishing these steps 4 and 5 from the ordinary steps 3, whereby the wheel chair 32 or the like can be safely placed on the proper steps.

Figure 11:
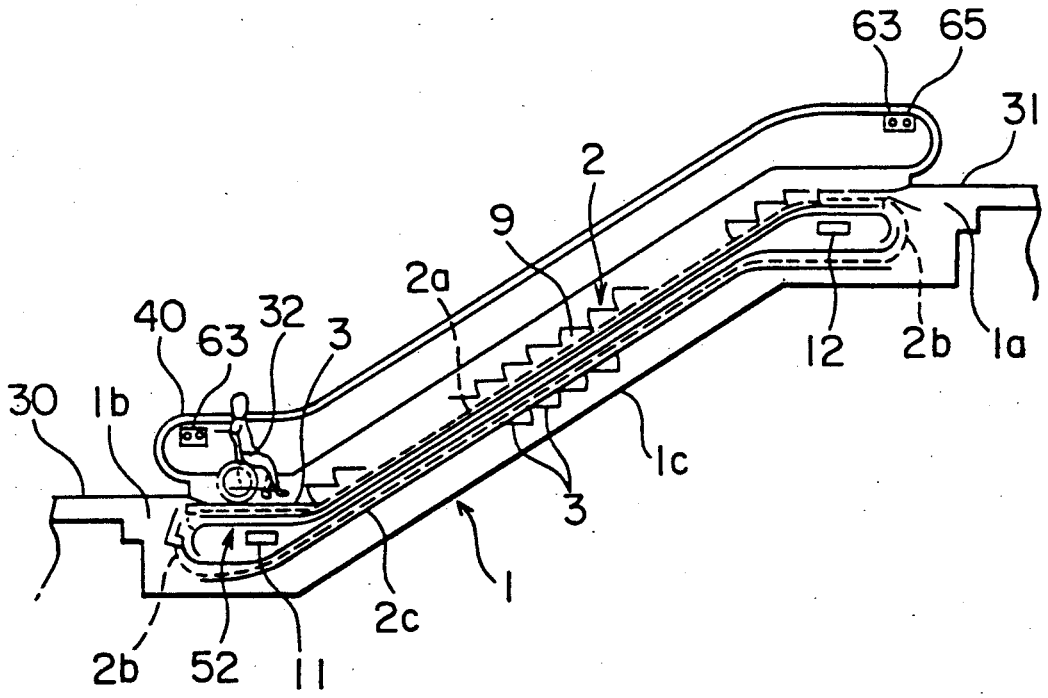
FIG. 11 is a view similar to FIG. 6 showing the second and the third embodiments of the present invention.
Figure 12:
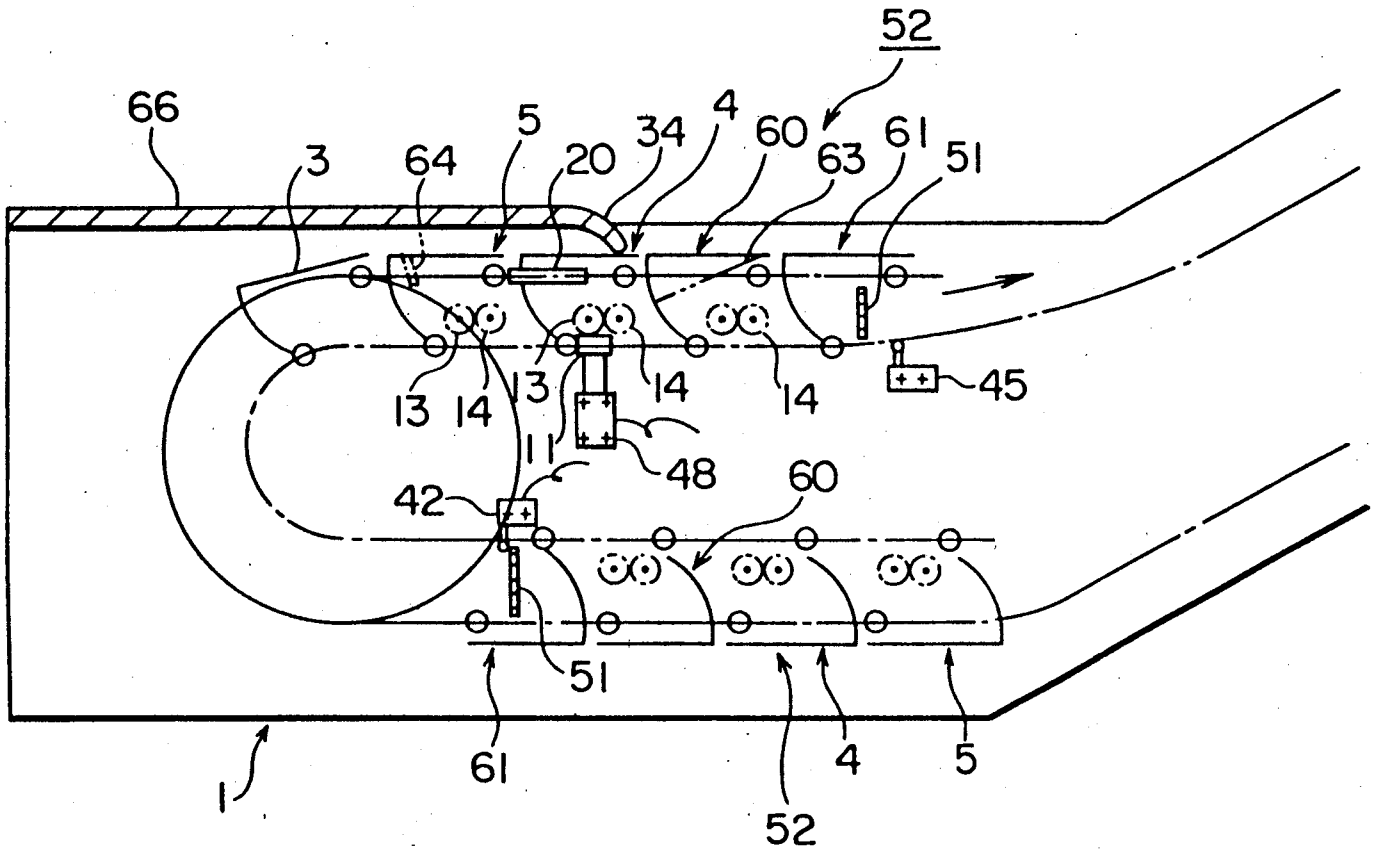
FIG. 12 is an enlarged view of the encircled portion II of FIG. 11.
Figure 13:
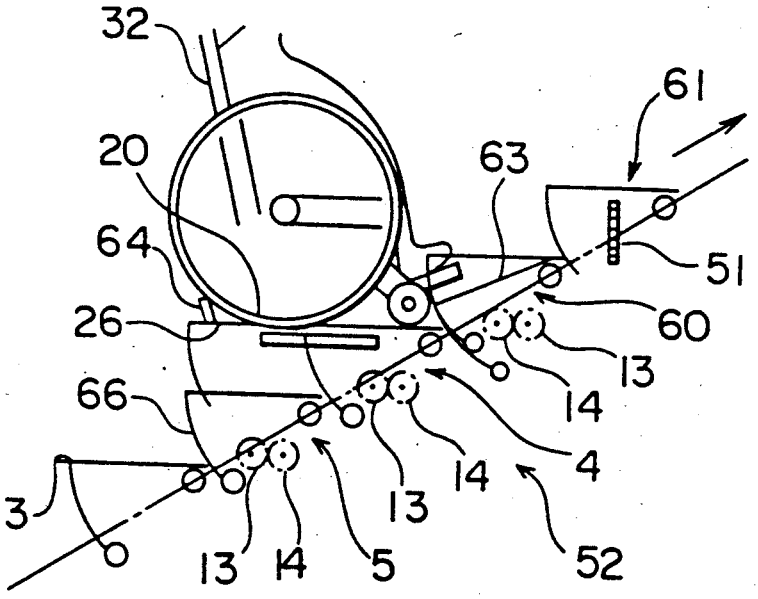
FIG. 13 is an enlarged view of the encircled portion III of FIG. 11.
Figure 14:
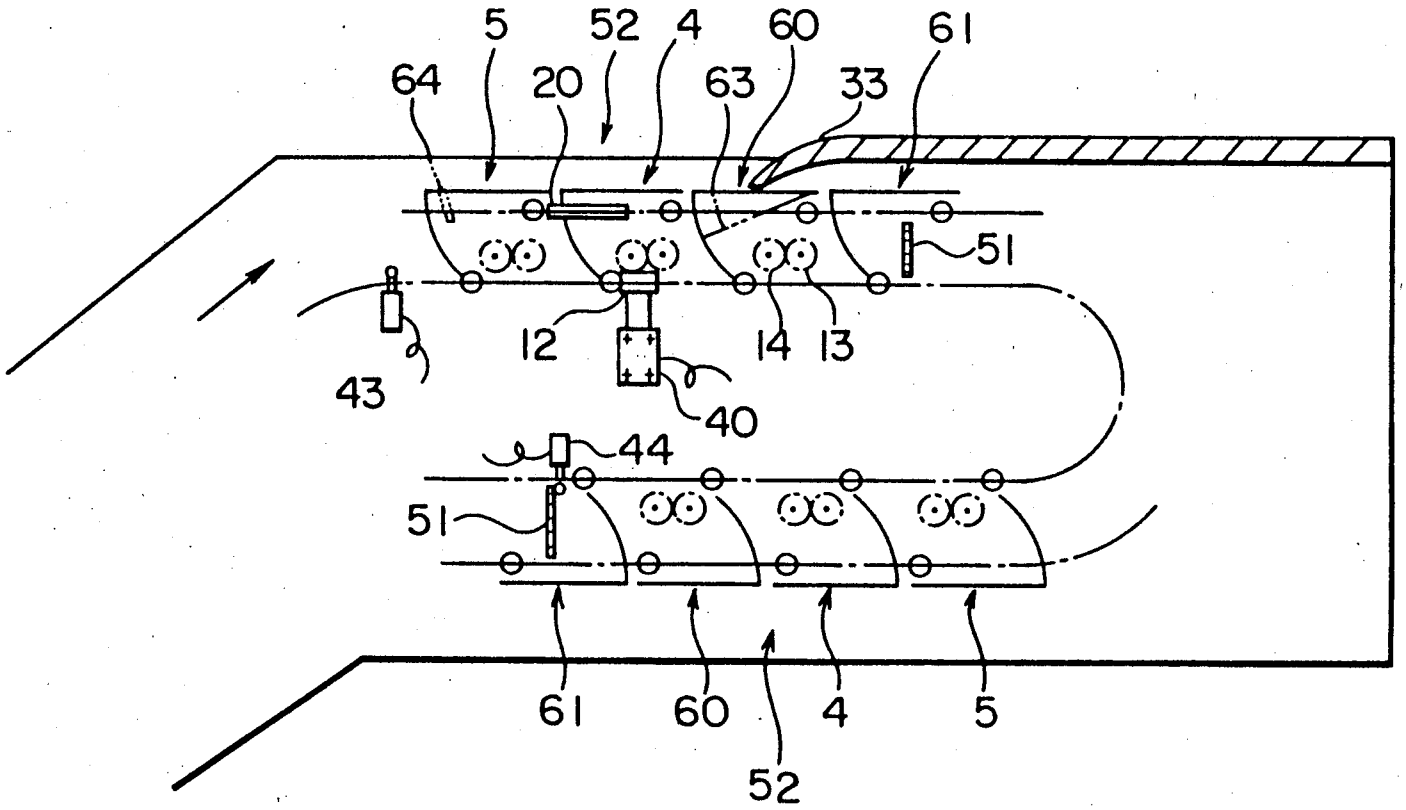
FIG. 14 is an enlarged view of the encircled portion IV of FIG. 11.

FIGS. 11 to 16 illustrate a third embodiment of the present invention, the basic structure of which is similar to that of the previous embodiment. FIG. 11 is a view corresponding to FIG. 6 of the first embodiment and the structures previously described and illustrated in conjunction with FIGS. 2 and 7 to 10 are also employed in the escalator of the third embodiment. This embodiment is similar to the first and the second embodiments except that a special wheel chair conveyor step 52 for a wheel chair comprises four steps 4, 5, 60 and 61, and that the escalator system comprises entrance and exit switches 42 and 45, an actuator 51, a wheel chair operation mode change-over switch 65, and a wheel chair operation mode start-up switch 41. It is seen that the wheel chair conveyor step 61 has securely mounted thereon an actuator 51, the wheel chair conveyor step 60 which is on the front side of the step 61 during upward movement of the escalator has a drop-down tread board 63, the intermediate wheel chair conveyor step 4 has an operating mechanism 21, and the wheel chair conveyor step 5 which is on the rear side of the step 61 has a movable tread board 26a and a wheel stopper 64.

Figure 15:
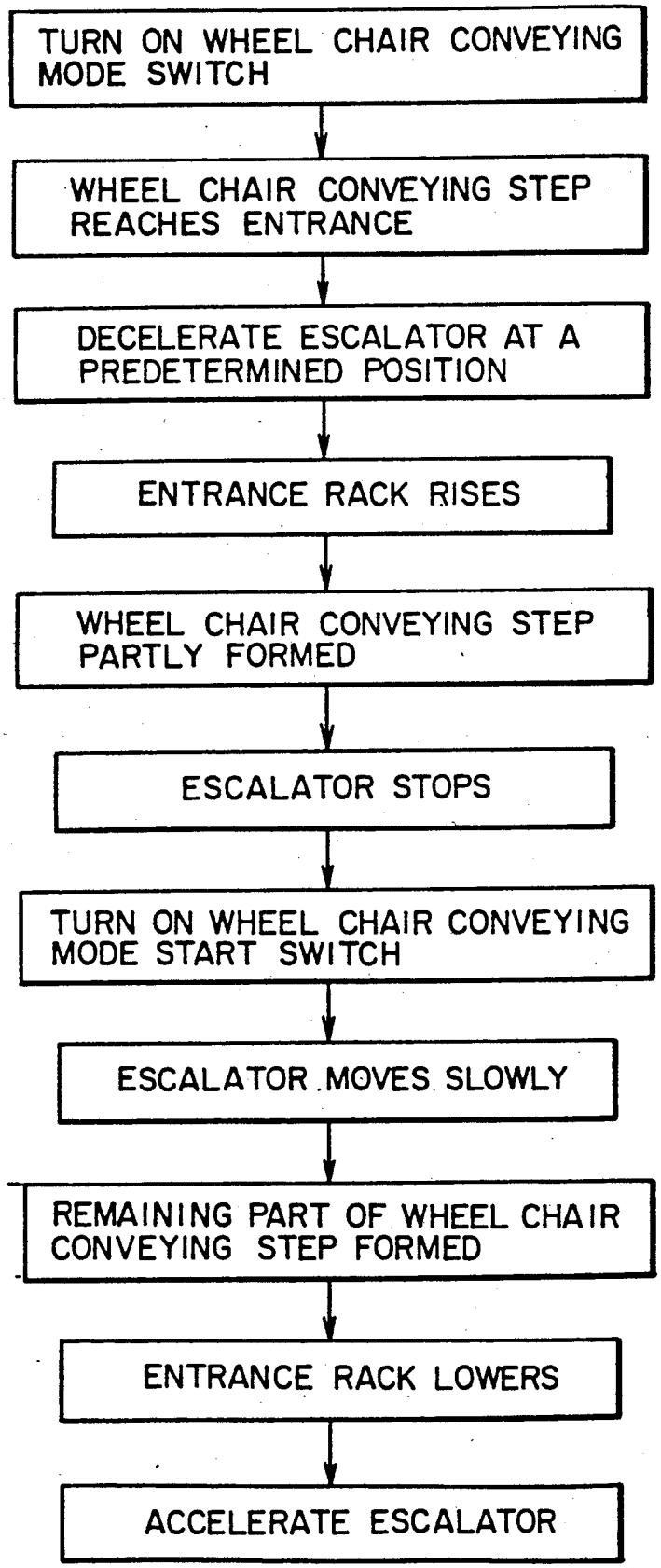
FIG. 15 is a flow chart showing the steps of placing a wheel chair onto the escalator system of the present invention.
Figure 16:
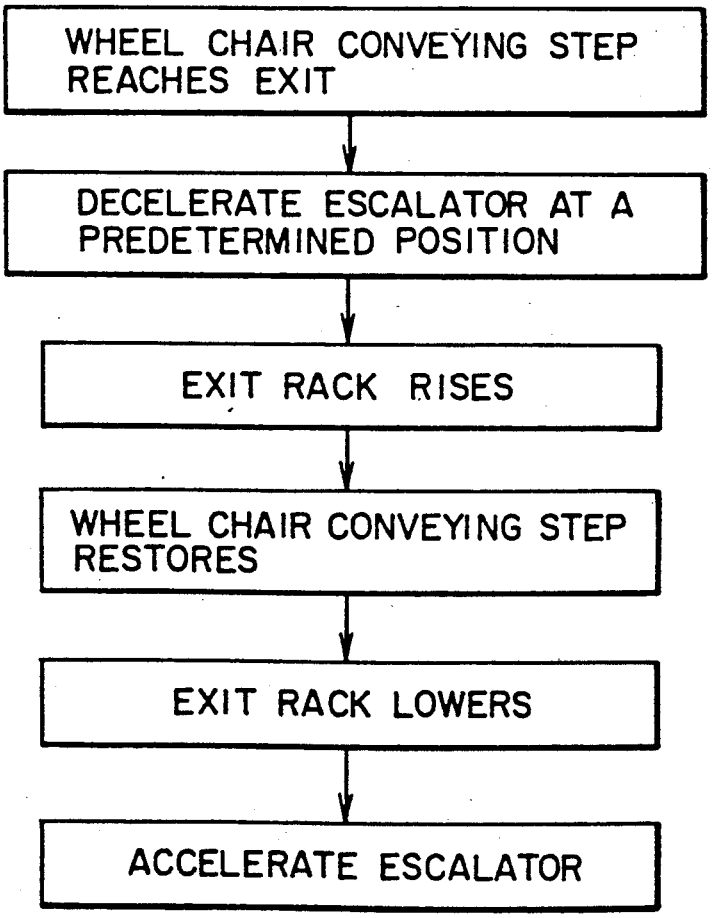
FIG. 16 is a flow chart showing the steps of placing down a wheel chair from the escalator system of the present invention.

During the upward movement, the operation of the escalator system is as illustrated in FIGS. 15 and 16.

That is, firstly, a person on the wheel chair 32 or an attendant pushes the wheel chair operation change-over switch 65 to change the mode of operation of the escalator system from normal operation to wheel chair conveying operation and puts the wheel chair 32 in a position ready for placing it on the escalator steps on the lower floor 30. In the wheel chair conveying mode, as the wheel chair conveying steps 4, 5, 60 and 61 approach the entrance portion or the load-bearing run of the lower end portion of the escalator, the actuator 51 mounted on the position detecting wheel chair conveying step 61 engages and acutates an entrance switch 42 to slow down the speed of the escalator at a predetermined position as well as to cause the electric motor 35 of the jack mechanism 40 at the lower end portion 1*b* of the main frame 1 to be driven in the forward direction, whereby the driving pinion 36 rotates in the forward direction and causes the first rack 11 to be elevated through the rack shaft 37 to the predetermined elevated position. The forward-rotation pinion 13 of the wheel chair conveying steps 4 and 60 travelling at the reduced speed sequentially engage the first rack gear 11 at the elevated position to make the movable tread board 63 be sloped and push out the forks 20, thereby forming a part of the wheel chair conveying step. That is, although the forward-rotation pinion 13 of the step 4 is in mesh with the first rack 11, since the forward-rotation pinion 13 travels together with the step 4 in the direction of arrow A shown in FIG. 7, the pinion 13 rotates in the clockwise direction shown by arrow B, and the forks 22 are pushed out rearwardly as shown by arrow D and inserted into the holes 27*a* and 28*a* of the fork-receiving members 27 and 28 of the inactivated movable member 26 of the movable step 5. It is to be noted that while the reverse-rotation pinion 14 is driven by the forward-rotation pinion 13 during the above operation, the reverse-rotation pinion 14 is in an idle state and its rotation is not transmitted to other components. Also, the above operation is carried out at the lower end portion of the load-bearing run 2*a* of the circulating path 2 where the tread board 4*a* of the operating step 4 and the treads of the movable tread board 26*a* of the movable step 5 are positioned at the same level and the forks 22 are inserted into the fork receiving members 27 and 28, the escalator being stopped at the entrance portion under these conditions. In this stopped position, the sloped tread board 63 of step 60 is inclined but not projecting above the movable tread board 26*a* of step 5. Under this condition, the wheel chair 32 is moved from the entrance floor 31 onto the tread board 4*a* of step 4 and the movable tread board 26*a* of step 5, and then the wheel chair conveying operation start switch 63 can be turned on so that the escalator starts to move at a slow speed. Then, the forward-rotation pinion 13 of step 5 engages the first rack 11 and the wheel stopper 64 projects above the movable tread board 26*a*. After step 4 reaches the sloped portion of the load-bearing run 2*a*, the movable member 26 is elevated relative to the step main body 66 of the movable step 5 as the step board 4*a* rises, and the escalator is accelerated and elevated with the tread board 4*a* and the movable tread board 26*a* maintained in the same horizontal plane, whereby the other portion of the wheel chair conveying steps is formed. At an appropriate time after the wheel stopper 64 is raised, the electric motor 35 of the jack mechanism 40 disposed at the lower end portion of the main frame 1 is driven in the reverse direction to return the first rack 11 to the inactivated position, whereby the escalator is accelerated and moved upwardly.

When the wheel chair conveying steps 4, 5, 60 and 61 approach the exit portion of the escalator, the actuator 51 of step 61 abuts against and actuates the exit switch 43, whereby the escalator is decelerated at a predetermined position and the electric motor 35 of the jack mechanism 40 disposed at the upper end portion of the main frame 1 is driven in the forward direction to elevate rack 12 which is an exit rack to a predetermined position. Then, the reverse-rotation pinion 14 of the wheel chair conveying steps 4, 5 and 60 sequentially engage rack 12 to cause the drop-down tread board 63, the forks 20 and the wheel stopper 64 to return to the position before they are activated. That is, the reverse-rotation pinion 14 of step 5 engages the rack 12 and is rotated in the direction shown by arrow E as shown in FIG. 8 and the forward-rotation pinion 13 is rotated in the counterclockwise direction as shown by arrow C, so that the forks 20 are retracted as shown by arrow F through the intermediate gear 18 from the fork receiving members 27 and 28 and placed under the tread board 4*a*. Therefore, the movable member 26 of the movable step 5 is lowered relative to the step main body 61 so that the movable tread board 26*a* is positioned at the same horizontal level as the tread board 4*a* and travels at the upper horizontal portion of the load-bearing run 2*a* in the direction shown by arrow A of FIG. 8. The wheel chair 32 is then removed at an appropriate time from the tread board 4*a* and the movable tread board 26*a* onto the landing floor 31. The movable tread board 26*a* passes through the comb member 33 at the upper end portion in the lowered position, and rack 12 is lowered by the operation of the jack mechanism 40 at the upper end portion of the main frame 1, the escalator is accelerated. The escalator travels through the turn-around portion 2*b*, the return run 2*c* and the turn-around portion 2*b* to return again to the lower end portion of the load-bearing run 2*a*, and the above operation is repeated.

During downward movement, the actuator 51 of the wheel chair conveying step 61 sequentially abuts against the entrance switch 44 and the exit switch 45, and the escalator system is operated in substantially the same manner as described above by switches 44 and 45. However, since the directions of travel of steps 3, 4, 5, 60 and 61 are opposite to those during upward movement, the reverse-rotation pinion 14 meshes with the elevated rack 12 at the upper end portion of the main frame 1 and the forks 20 engage the fork receiving members 27 and 28, and the forward-rotation pinion 13 meshes with the elevated rack 11 at the lower end portion of the main frame 1 and the forks 22 disengage from the fork receiving members 27 and 28.

Also, during ordinary operation, the movable tread board 26*a* is maintained in the lowered state because the jack mechanisms 40 are not activated, so that ordinary passengers can be conveyed by steps 3, 4, 5 and 60.

In the above described embodiment, the escalator is temporarily stopped when the wheel chair is to be loaded onto the escalator but not stopped when the wheel chair is to be unloaded from the escalator, and since the escalator is decelerated when the wheel chair is to be loaded and unloaded, the engagement between the rack elevated by the jack mechanisms and the forward-rotation and reverse-rotation pinions mounted on the step is ensured. However, this deceleration of the escalator is not always necessary in this third embodiment of the invention. The reason that the escalator is temporarily stopped only upon the loading of the wheel chair is for ensuring that the wheel chair is safely mounted on the wheel chair conveying steps, whereas during the unloading of the wheel chair, the wheel chair is safe even when it fails to be moved from the steps onto the landing floor because the treads of the steps are all at the same level in the landing area.

Also, the step with the drop-down tread board of the third embodiment can be eliminated and the operating mechanism can be suitably modified. Further, in the second and the third embodiments, the jack mechanisms 40 for the racks 11 and 12 may be replaced with an electromagnetic plunger or a hydraulic cylinder, and an ordinary step may be inserted between the step which the actuator is mounted and the step with the forward-rotation pinion and the reverse-rotation pinion.

While the rack 11 of the above-described embodiments has teeth on the surface of the rack, a chain may be mounted on the surface of the rack 11 instead of the rack teeth. Alternatively, a chain may be mounted on another suitable member other than the rack. Also, a sprocket wheel may be used in place of the pinions 13 and 14 employed in the above-described embodiments.

As has been described, according to the present invention, a rack is mounted on a jack mechanism disposed at opposite end portions of the main frame, and a forward-rotation pinion and a reverse-rotation pinion engageable with one of the elevated racks are rotatably mounted on the step with a movable member or the step next to the step with the movable member. The forward-rotation pinion and the reverse-rotation pinion cause the driving force transmitting mechanism at the opposite ends of the main frame to be operated in opposite directions so that the movable member is moved between the actuated and the inactuated positions. Therefore, the movable member such as the tread board, the wheel stopper and the drop-down tread board can be operated by utilizing the movement of the escalator steps without the need for manual operation. Also, since there is no need for the escalator to be stopped upon returning the movable member to its original position, a relatively high operating efficiency of the escalator system can be maintained.

What is claimed is:

1. An escalator system comprising:

a main frame defining a circulating path;

a first step disposed on the main frame for movement along the circulating path;

a second step disposed on the main frame adjoining the first step for movement along the circulating path, the second step having a movable tread movable between a raised position and a lowered position;

an operating mechanism mounted on the first step and comprising a support movable between a retracted position and an extended position in which it engages with and supports the movable tread;

a first rotatable member mounted on one of the steps and coupled with the operating mechanism for driving the operating mechanism to move the support from the retracted position to the extended position when rotated in a first direction;

a second rotatable member mounted on one of the steps and coupled with the operating mechanism for driving the operating mechanism to move the support from the extended position to the retracted position when rotated in the first direction;

a first engaging member mounted on the main frame for engaging with the first rotatable member and rotating the first rotatable member in the first direction; and a second engaging member mounted on the main frame for engaging with the second engaging member and rotating the second rotatable member in the first direction.

2. An escalator system as claimed in claim 1 wherein the first and second engaging members are disposed along the path of movement of the first and second rotatable members as the steps move along the circulating path in locations such that the movement of the steps will cause the first and second rotatable members to engage the first and second engaging members, respectively, and be rotated in the first direction by the engagement.

3. An escalator system as claimed in claim 1 wherein the first and second rotatable members are pinions operatively connected to the operating mechanism, and the first and second engaging members are racks having gear teeth for meshing with the pinions.

4. An escalator system as claimed in claim 1 further comprising means for moving the engaging members into and out of the path of movement of the rotatable members.

5. An escalator system as claimed in claim 4 wherein the means for moving the engaging members comprises means for moving each engaging member to a location along the path of movement of the corresponding rotatable member before the corresponding rotatable member reaches the location.

6. An escalator system as claimed in claim 1 wherein the first and second rotatable members are connected with each other such that rotation of one of the rotatable members in the first direction causes the rotation of the other rotatable member in a second direction opposite the first direction.

7. An escalator system as claimed in claim 6 wherein:

rotation of the first rotatable member in the second direction drives the operating mechanism to move the support from the extended position to the retracted position; and rotation of the second rotatable member in the second direction drives the operating mechanism to move the support from the retracted position to the extended position.

8. An escalator system as claimed in claim 1 wherein the first and second rotatable members are mounted on the first step.

9. An escalator system comprising:

a main frame defining a circulating path;

a first step disposed on the main frame for movement along the circulating path;

a second step disposed on the main frame adjoining the first step for movement along the circulating path, the second step having a movable tread movable between a raised position and a lowered position;

an operating mechanism mounted on the first step and comprising a support movable between a retracted position and an extended position in which it engages with and supports the movable tread;

a first rotatable member mounted on one of the steps and coupled with the operating mechanism for driving the operating mechanism to move the support between the retracted position and the extended position; and a first engaging member disposed on the main frame in a first location along the path of movement of the first rotatable member for engaging with and rotating the first rotating member as the steps are moving along the circulating path.

10. An escalator system as claimed in claim 9 wherein the circulating path has a sloping portion in which the steps move along a slope and a horizontal portion in which the steps move horizontally, and the first engaging member is disposed in a location so as to engage with the first rotatable member when the first and second steps are on the horizontal portion.

11. An escalator system as claimed in claim 9 further comprising:

a second rotatable member mounted on one of the steps and coupled with the operating mechanism for driving the operating mechanism to move the support between the extended position and the retracted position; and a second engaging member mounted on the main frame in a second location along the path of movement of the second rotatable member for engaging with and rotating the second rotatable member as the steps are moving along the circulating path.

12. An escalator system comprising:

a main frame defining a circulating path;

a plurality of steps disposed on the main frame for movement along the circulating path and including a movable step having a movable tread movable between a raised position and a lowered position;

an operating mechanism mounted on one of the steps for moving the movable tread between the raised and lowered positions;

a first rotatable member mounted on one of the steps and coupled with the operating mechanism such that rotation of the first rotatable member in a first direction causes the operating mechanism to move the movable tread to the raised position;

a second rotatable member mounted on one of the steps and coupled with the operating mechanism such that rotation of the second rotatable member in the first direction causes the operating mechanism to move the movable tread to its lowered position;

a first engaging member mounted on the main frame for engaging with the first rotatable member and rotating the first rotatable member in the first direction; and a second engaging member mounted on the main frame for engaging with the second engaging member and rotating the second rotatable member in the first direction.

13. An escalator system as claimed in claim 12 wherein the movable tread is mounted on the movable step for vertical movement between a raised position and a lowered position, and the operating mechanism comprises a support mounted on a step adjoining the movable step and movable between a retracted position and an extended position in which it engages with and supports the movable tread in the raised position.

* * * * *